US006390312B1

(12) United States Patent
Bean

(10) Patent No.: US 6,390,312 B1
(45) Date of Patent: May 21, 2002

(54) LIFT STRUCTURES AND LIFTING ARRANGEMENT THEREFOR

(75) Inventor: Andrew Jay Bean, Greencastle, PA (US)

(73) Assignee: JLG Industries, Inc., McConnellsburg, PA (US)

( * ) Notice: Subject to any disclaimer, the term of this patent is extended or adjusted under 35 U.S.C. 154(b) by 0 days.

(21) Appl. No.: 09/032,390

(22) Filed: Feb. 27, 1998

(51) Int. Cl.[7] ..... B66C 23/00

(52) U.S. Cl. ..... 212/300; 212/238; 212/261; 212/270; 182/2.9; 182/2.11

(58) Field of Search ..... 212/299, 300, 212/230, 231, 232, 238, 261, 270; 182/2.8, 2.9, 2.11

(56) References Cited

U.S. PATENT DOCUMENTS

| | | | | |
|---|---|---|---|---|
| 3,891,056 A | | 6/1975 | Ashworth | 182/148 |
| 4,643,273 A | | 2/1987 | Stokoe | 182/2 |
| 4,687,406 A | * | 8/1987 | Kinsey | 414/701 |
| 4,775,029 A | | 10/1988 | MacDonald et al. | 182/2 |
| 4,944,364 A | | 7/1990 | Blasko | 182/2 |
| 4,953,666 A | | 9/1990 | Ridings | 187/9 R |
| 5,016,767 A | | 5/1991 | Thibault | 212/188 |
| 5,249,643 A | | 10/1993 | Backer et al. | 182/2 |
| 5,460,246 A | | 10/1995 | Burch et al. | 182/63 |
| 6,024,191 A | * | 1/2000 | Backer et al. | 182/69.6 |

OTHER PUBLICATIONS

JLG Industries, Inc.: "600 Series Articulating Boom Lifts".
Genie Industries: "Z–45/22", 1991.
UNO: "4X4 Series Work Platforms", 1989.
Condor Calavar: "86A Aerial Work Platforms".

* cited by examiner

*Primary Examiner*—Thomas J. Brahan
(74) *Attorney, Agent, or Firm*—Reed Smith LLP

(57) ABSTRACT

Load-bearing apparatus, such as a boom lift, including first and second arm portions, in which at least one element, such as a hydraulic cylinder, is provided for selectively imparting a predetermined dependent relationship as well as a predetermined independent relationship between the first and second arm portions. The manufacture of such load-bearing apparatus can be customized by preselecting the dependent and independent relationships by altering given parameters.

24 Claims, 13 Drawing Sheets

PRIOR ART

PRIOR ART

LIFT STRUCTURES AND LIFTING ARRANGEMENT THEREFOR

FIELD OF THE INVENTION

The present invention generally relates to lift structures and/or load-bearing vehicles.

BACKGROUND OF THE INVENTION

Historically, there have been developed a wide range of lift structures that are arranged in such a manner as to elevate personnel or material in order to provide facilitated access to an elevated location.

Different types of lifts vary in size, shape and function. For example, "vertical pole" lifts generally involve the use of a telescoping mast or sequentially extending mast (in which mast segments are usually "stacked" along a horizontal direction and then propagate upwardly one-by-one), on which is mounted a basket, cage or other platform structure intended to carry one or more individuals. Most "vertical pole" lifts are intended to carry only one individual, however, and are generally designed to elevate solely in a vertical direction. U.S. Pat. No. 3,752,261 (Bushnell, Jr.), U.S. Pat. No. 4,657,112 (Ream et al.) and U.S. Pat. No. 4,015,686 (Bushnell, Jr.) disclose general examples of such lifts.

"Scissors lifts", on the other hand, involve the use of a scissors-type mechanism for propagating a basket, cage or platform upwardly. Again, the propagation is solely along a generally vertical direction, but in this case the more rigid structure of the scissors mechanism permits greater loads to be propagated and carried. U.S. Pat. No. 5,390,760 (Murphy) and U.S. Pat. No. 3,817,846 (Wehmeyer) disclose general examples of such lifts.

"Boom lifts" involve the use of a pivotable, and often extendible, boom structure to propagate a basket, cage or platform both upwardly and in a variety of other directions. U.S. Pat. No. 3,861,498 (Grove) and U.S. Pat. No. Re. 31,400 (Rallis, et al.) disclose general examples of such lifts.

Other types of lifts, not typically falling into one of the three categories outlined above, can also be used for similar purposes, that is, for propagating personnel or material in a generally upward direction to access an elevated workspace. U.S. Pat. No. 4,488,326 (Cherry), U.S. Pat. No. 3,927,732 (Ooka et al.), U.S. Pat. No. 5,299,653 (Nebel), U.S. Pat. No. 4,154,318 (Malleone), U.S. Pat. No. 4,799,848 (Buckley) and U.S. Pat. No. 4,147,263 (Frederick et al.) disclose general examples of lifts outside of the three categories discussed above.

Many types of vehicles and lift structures, especially boom lifts, excavators, cranes, backhoes, and certain other machines, have centers of mass that migrate significantly during use. In contrast, automobiles and similar vehicles have their lateral centers of mass located at some point substantially along the longitudinal axes thereof and these tend not to migrate significantly at all. Thus, a migrating center of mass has been a perennial problem with certain vehicles or machines, including boom lifts.

For example, as the boom of a boom lift is extended and a load is applied to the platform or bucket thereof, the lift's center of mass moves outwardly toward the supporting wheels, tracks or outriggers. If a sufficient load is applied to the boom, the center of mass will move beyond the wheels and the lift will tip over. The imaginary line along a support surface (e.g., the ground) about which a vehicle tips is known as the "tipline". A more detailed discussion of the principles of tipping is provided in copending and commonly assigned U.S. patent application Ser. No. 08/890,863, which is hereby incorporated by reference as if set forth in its entirety herein.

By defining the tipline of a vehicle as near to the perimeter of the vehicle's chassis as possible, the stability of the vehicle is increased. This increase in stability permits the vehicle to perform its intended function with the minimum amount of necessary counterbalance weight, which results in lower costs, improved flotation on soft surfaces, easier transport, etc.

In the context of boom lifts, two types of stability are generally addressed, namely "forward" and "backward" stability. "Forward" stability refers to that type of stability addressed when a boom of a boom lift is positioned in a maximally forward position. In most cases, this will result in the boom being substantially horizontal. On the other hand, "backward" stability refers to that type of stability addressed when a boom of a boom lift is positioned in a maximally backward position (at least in terms of the lift angle). In most cases, this will result in the boom being close to vertical, if not completely so.

In a typical boom lift, not only can the boom be displaced (i.e., pivoted) through a vertical plane, but also through a horizontal plane. The horizontal positioning is usually effected via a turntable that supports the boom. As the wheeled chassis found in typical boom lift arrangements will usually not exhibit complete circumferential symmetry of mass, it will be appreciated that there exist certain circumferential positions of the boom that are more likely to lend themselves to potential instability than others. Thus, in the case of a boom lift in which the chassis or other main frame does not exhibit symmetry of mass with regard to all possible circumferential positions of the boom, then a greater potential for instability will exist, for example, along a lateral direction of the chassis or main frame, that is, in a direction that is orthogonal to the longitudinal lie of the chassis or main frame (assuming that the "longitudinal" dimension of the chassis or main frame is defined as being longer than the "lateral" dimension of the chassis or main frame). Thus, when designing the boom lift for safety requirements, these circumferential positions of maximum potential instability must be taken into account.

Historically, it has been the norm to ensure the presence of a counterweight to the boom. In this manner, when the boom is in a maximally forward position, the counterweight, situated on the opposite side of the tipline from the boom, will help counteract the destabilizing moment contributed to by the boom (with personnel or material load).

The use of a counterweight does have somewhat of an opposite consequence, however, when one considers the issue of backward instability. Particularly, when a boom is moved into a maximally backward position, it will be appreciated that a destabilizing moment, contributed to by the boom (with personnel or material load) and counterweight, could act in a backward direction. On the other hand, if a destabilizing moment is not present, even a small net stabilizing moment might be undesirable. Thus, it has been the norm to accord the chassis or other main frame an even greater weight than might be desired, for the purpose of counterbalancing the destabilizing moment that contributes to backward instability.

Although the measures described hereinabove have conventionally been sufficient to reduce the risk of vehicle tipping in either a forward or a backward direction, concern has arisen in the industry over the costs associated with providing an overly massive vehicle chassis. The mass of a vehicle chassis not only has ramifications in manufacturing costs, but also in transport costs or in other factors, such as the load that might be applied to fragile surfaces (e.g. mud). Accordingly, a need has been recognized in conjunction with keeping such additional mass to a minimum.

Therefore, a need has been recognized in conjunction with the provision of a lift structure of reduced weight that does not compromise stability and/or with the provision of a lift structure in which a greater range of movement of the item being moved is provided for a given overall weight of the lift structure.

Other needs have been recognized in conjunction with given lift structures, as discussed herebelow.

An important consideration in the design and manufacture of load-bearing apparatus, such as boom lifts, is the range of motion afforded by the apparatus or lift. Typically, a lift or other type of load-bearing apparatus will have a predetermined "work envelope" based on the components used in manufacturing the apparatus as well as the geometry, positioning and dimensions of such components. Depending on the intended use of the apparatus at hand, it might be desirable to provide a significantly large work envelope or, on the other hand, a more limited work envelope might be sufficient.

In the realm of articulated boom lifts and other similar structures, a significantly large work envelope, although possibly desirable in view of the number and variety of boom positions that might be attainable, might sacrifice lift stability as a result. For example, there might be several rearward positions in a large work envelope that could invite backward instability. For this reason, many previous efforts have sought to decrease the available work envelope in order to eliminate positions of backward or forward instability. However, as will be discussed herebelow, most such efforts have involved specific structures and components that are complex in nature and do not easily lend themselves to facilitating customization of the apparatus or lift in question for particular intended uses.

Certain types of conventional boom lifts, such as the JLG 600A boom lift manufactured by JLG Industries of McConnellsburg, Pa., are of an "articulated" nature, and include the following basic components: tower boom, upright, upper boom and related hydraulic cylinders. Typically, provisions are made to permit the upright to be leveled by way of cylinders, in relation to the horizontal. Similar provisions can be provided to level the work platform in continuous manner. In several conventional approaches, there is a master-slave cylinder relationship between the work platform and the upright that permit both items to remain level, as in commonly assigned U.S. Pat. No. 4,775,029 to MacDonald et al, which is hereby incorporated by reference as if set forth in its entirety herein.

Other conventional articulated boom lifts, on the other hand, involve the use of multi-segmented tower booms. Also, several conventional lifts utilize parallelogram bars or "pseudo-parallelogram" bars in tower booms or tower boom segments.

Some examples of lifts that involve a purely independent relationship between a tower boom and upper boom, or between two segments of a multi-segmented tower boom, are discussed herebelow.

In the aforementioned MacDonald patent and in many other known arrangements, the upper boom moves completely independently of the tower boom. Typically, one or more hydraulic cylinders (i.e., lift cylinders) might extend between the upright and the upper boom for the independent purpose of controlling the movement of the upper boom, while one or more other hydraulic cylinders (leveling cylinders) might extend between the tower boom and the upright for the purpose ofkeeping the upright level. Of course, one or more hydraulic cylinders will preferably be provided to raise the tower boom itself.

Advantages have been enjoyed in conjunction with structures such as those just described, in comparison with previously known arrangements. For instance, the aforementioned patent to MacDonald et al. lends itself readily to the incorporation of a telescoping tower boom, which itself provides the advantage of selective extension of the tower boom to achieve significant raising of the upper boom without the need to resort to a fixed-length tower boom that might have an undesirably large stowed length. The raising or lowering of the tower boom in the MacDonald patent is always hydraulically in tandem with the upright member interconnecting the lower and upper boom, thereby maintaining the upright member in a level or plumb position. In a generally similar manner, the raising or lowering of the upper boom is accomplished in coordination with the orienting of the operator's platform so as to maintain the latter at a level position regardless of the angle of elevation of the upper boom. All of these features are accomplished while at the same time providing a boom lift having a relatively low stowed height and stowed length for convenience of transportation, and having relatively few moving parts and pivot points for maintaining the operator's platform in a level position. Other details relating to structural and operational aspects of the structures just described may be found in the aforementioned patent to MacDonald et al.

The Snorkel company of St. Joseph, Mo., has produced a series of lifts, namely the "UNO 4×4 Series", in which two tower boom segments are completely independent with respect to one another. Thus, there are completely separate and independent cylinders that separately actuate each of the two tower segments. No arrangement appears to be provided for automatically limiting the range of movement of the tower segments. The inherent disadvantage of such an arrangement is that the working envelope is so broad as to increase the number of potential positions of instability. U.S. Pat. No. 4,944,364 to Blasko also appears to disclose an arrangement that involves independent motion of the upper boom and tower (or lower) boom with respect to one another. Particularly, two cylinders are used in series to increase the range of motion of the lower boom, and a linkage in between them is provided to maintain the necessary mechanical advantage.

U.S. Pat. No. 4,643,273 to Stokoe appears to disclose an arrangement in which an upper boom moves independently with respect to a lower boom, yet the independent motion of the upper boom is restricted. In the Stokoe patent, a cylinder appears to extend between a lower boom and an upper boom and an intermediate linkage appears to be necessary. The cylinder is pinned not on the lower boom itself or any portion thereof, but on a linkage that is separate from a hinge. Therefore, this would appear to be analogous to the known concept of pinning an upper lift cylinder on a component that is itself an intermediary between upper and lower boom structures, and would thus not appear to represent a significant departure from that concept. The result of the Stokoe arrangement appears to be nothing more than increasing the range of angular motion between the two booms.

The Stokoe arrangement appears to disclose an independent relationship of the upper boom and tower boom with respect to one another, but this appears to be restricted by a "stair-step" procedure that is used for raising the work platform. Particularly, it appears that the upper boom cannot be moved until the tower boom is raised. This discretely segmented method of raising the booms would appear to encompass several disadvantages, not the least of which are the inefficiency of movement, unreasonably limited ranges of movement, and possible discomfort and inconvenience for the operator on the work platform.

U.S. Pat. No. 3,894,056 to Ashworth appears to disclose an arrangement in which a cylinder, pinned on a lower boom, actuates without any other intermediary components that are directly attached to an upper boom, although it would appear that a rather complex arrangement is disclosed. Particularly, as best illustrated by FIG. 2 of that patent, a first cylinder, pinned on the lower boom, is connected to the upper boom via a rod. However, a second rod is also present, this being connected at another point on the lower boom. The result is merely to extend the range of angular motion between the two booms. Further linkages and rods are also disclosed which operate in an apparently complex manner in order to limit the positions of the booms and thus prevent the entire boom structure from assuming a potentially unstable configuration.

Generally, in the Ashworth device, independent movement of the upper and lower booms with respect to one another is afforded by separately actuable hydraulic cylinders. Since the complex system of stops and linkages appears to be geared to the very specific purpose of limiting the action of the separately actuable cylinders to maintain lift stability, it would appear that versatility in positioning might be sacrificed. Furthermore, the structure disclosed in the Ashworth patent, since it involves fixed linkages between the tower boom and the upper boom, would appear to preclude the use of a telescoping tower boom, which itself has its own attendant advantages as discussed herein.

The disclosure now turns to a discussion of previous efforts that involve a strictly dependent relationship between an upper boom and a lower boom, or between two segments of a multi-segmented tower boom.

U.S. Pat. No. 4,953,666 to Ridings appears to disclose an elevating apparatus for raising and lowering a work station between a downwardly declining, compact retracted position and an upwardly inclining extended limit position. The work station is connected to a mobile support base by parallelogram first and second boom assemblies which are operatively interconnected by a boom assembly coupler and rigid compression link. Raising or lowering the first boom assembly by a hydraulic lift cylinder arrangement causes the second boom assembly to move correspondingly such that the work station moves vertically, unaccompanied by any substantial horizontal motion, and is maintained in a level attitude throughout the range of motion of the apparatus via the action of the parallelogram arms.

Some disadvantages and shortcomings have been noted with the Ridings device. Primarily, the two booms are completely dependent on one another for their movement, thus imparting to the lift a potentially limited range of composite boom positions. The options available to the operator are thus quite limited. For example, there is essentially no provision for gaining additional "outreach", or supplemental horizontal positioning for given vertical positions.

Genie Industries of Redmond, Wash., has developed a "Z-45/22" lift that involves a two-segment tower boom, with parallelogram structures used for each of the segments. In similar manner to the Ridings device, motion between the two tower boom segments is completely interdependent. The link between the two tower boom segments is apparently similar to that of the Ridings device, as well.

In the aforementioned Genie device, a hydraulic cylinder is also added between the two tower boom segments, but this appears to be nothing more than a lift cylinder that, because of the interdependency between the two tower segments, provides all of the lifting action for the two tower segments (even for movement of the lower tower segment with respect to the chassis). Because of the parallelogram structure of the tower boom segments, neither segment can readily lend itself to the incorporation of a telescoping tower boom segment.

Finally, the Calavar Corporation of Waco, Tex., has produced an articulated telescopic boom lift, namely the Condor 86A, which involves a mechanical four-bar linkage for displacing the upright. The platform is not apparently leveled relative to the upright, but is apparently leveled electronically by way of tilt sensors in the platform area of the lift. No leveling relationship is thus maintained between the upright and the horizontal.

Apparently, the upright changes its vertical orientation as the tower boom is raised from its stowed position to its fully elevated position. Apparently, the placement of the four-bar linkage pins serves to carry out this angular change of the upright, possibly by rendering the linkage bars slightly out of parallel with respect to one another (when viewed along a vertical plane). The upper boom lift cylinder is pinned to the upright, so the upper boom changes angle as the tower boom is raised.

Some disadvantages have been noted, however, with respect to this Condor design. For one, the four-bar linkage prevents the use of a telescopic tower boom, thus limiting the height of the upper boom and adding to horizontal outreach, thus increasing the potential for forward instability. Further, as mentioned above, the constantly changing upright angle precludes the use of hydraulic leveling of the platform, meaning that the aforementioned complicated arrangement of tilt sensors is required. Additionally, the upright is inclined when the boom is in the stowed position, thus adding to stowed length and to the degree of tailswing. Because of the increased degree of tailswing, there is also the potential for increased backward instability.

Another disadvantage with the Condor device may be found in that the four-bar linkage places limitations on the location of the upper lift cylinder. Particularly, the positioning of the lower four-bar linkage appears to necessitate placement of the upper boom beside the lower boom, rather than in a "boom-over-boom" arrangement, in which the center lines of the booms essentially lie in the same vertical plane to permit one of the booms to nest within the other with the booms in a stowed position. The disadvantage of such an arrangement is that the composite boom structure will have a greater width than might be desired, thus adding complexity to packaging and transport, and the offset center lines of the booms will result in a lateral moment, which might lead to unwanted deflections in the machine.

In view of the foregoing, a need has also thus been recognized in conjunction with the provision of a lift arrangement in which a degree of versatility and flexibility is offered with respect to both maintaining stability of the lift and affording a desired range of motion.

SUMMARY OF THE INVENTION

In accordance with a presently preferred embodiment of the present invention, the upper lift cylinder has essentially become multi-functioned, in that it is used as a link to tie the motion of the tower boom to the upper boom as well as being used as an actuator for upper boom positioning. The booms are thus tied together mechanically so when the tower boom is raised, the upper boom is also raised due to the geometry of the upper boom lift cylinder attachment. Furthermore, this arrangement advantageously permits the use of a telescoping tower boom (if desired) as well as a master-slave connection between an upright and a work platform.

Generally, at least one presently preferred embodiment of the present invention broadly contemplates load-bearing apparatus comprising: a first arm portion; a second arm portion; and at least one element for: selectively imparting a predetermined dependent relationship between the first and second arm portions; and selectively imparting a predetermined independent relationship between the first and second arm portions.

Further, at least one presently preferred embodiment of the present invention broadly contemplates a method of making load-bearing apparatus, the method comprising the steps of: providing a first arm portion; providing a second arm portion; and providing at least one element for: selectively imparting a predetermined dependent relationship between the first and second arm portions; and selectively imparting a predetermined independent relationship between the first and second arm portions.

BRIEF DESCRIPTION OF THE DRAWINGS

The present invention and its presently preferred embodiments will be better understood by way of reference to the detailed disclosure herebelow and to the accompanying drawings, wherein.

DESCRIPTION OF THE PREFERRED EMBODIMENTS

Throughout the instant disclosure, it will be appreciated that several terms may be used interchangeably with one another, some of which are briefly discussed immediately below.

The terms "basket", "cage", "platform", "work platform", "working platform", "platform structure", "bucket" and "carriage" are all indicative of portions of a lift structure on or in which one or more individuals, or a load of material, may be positioned so as to be raised to an elevated location. It is to be understood that the occurrence of any of these terms singly can be taken to indicate the interchangeability therewith of any of the other terms.

In the instant disclosure, the term "boom" should be understood to be indicative of essentially any device or instrument that provides extended reach, either for the purposes of moving personnel for doing work, or for moving goods, or both. Thus, in the instant application, the term "boom" not only can be taken to be indicative of a telescoping and/or articulated boom lift, but might also include those types of mechanical extensions found in essentially any analogous equipment such as, for example, excavators, cranes, backhoes, tree harvesters, mechanical pincers and other similar machines.

It is to be understood that the terms "boom structure" and "composite boom structure", as employed herein, refer to the collective arrangement of booms or boom segments utilized in a lift such as, for example, a tower boom and upper boom in sum.

Figure 1:
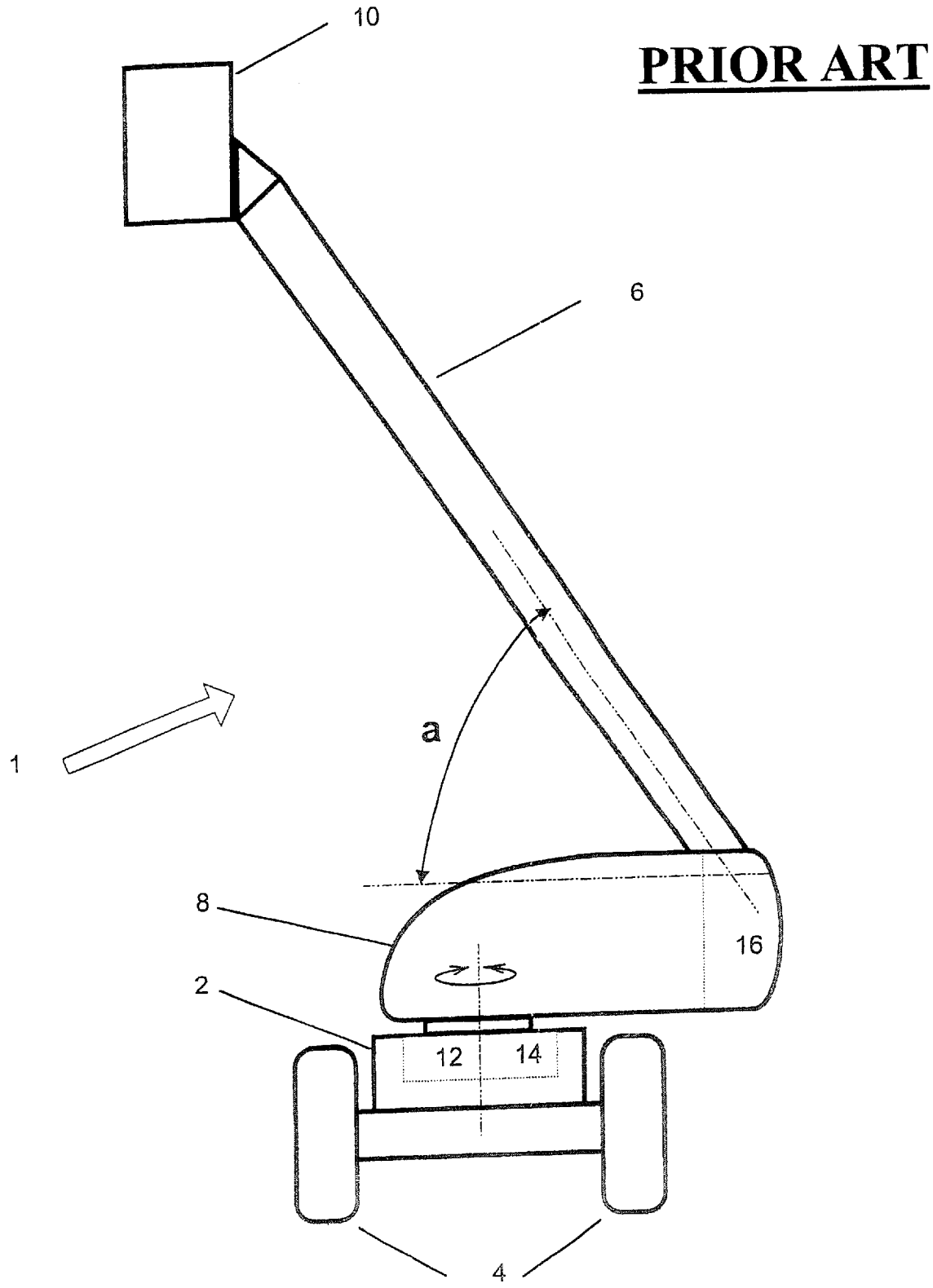
FIG. 1 is a schematic elevational representation of a lift structure and associated components.
Figure 2A:
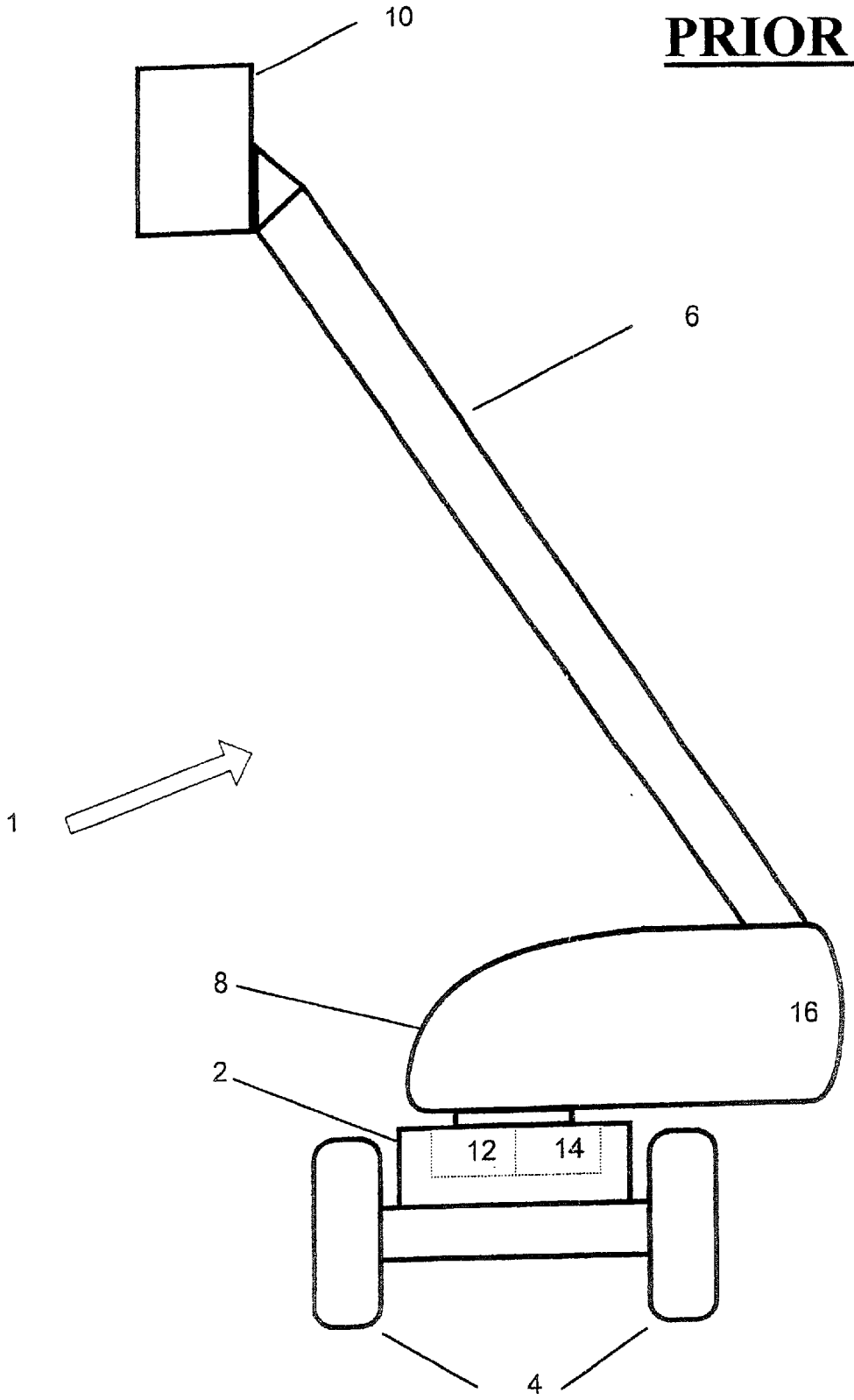
FIG. 2*a* is essentially the same view as FIG. 1, illustrating the boom of the lift structure in a vertically intermediate position.
Figure 2B:
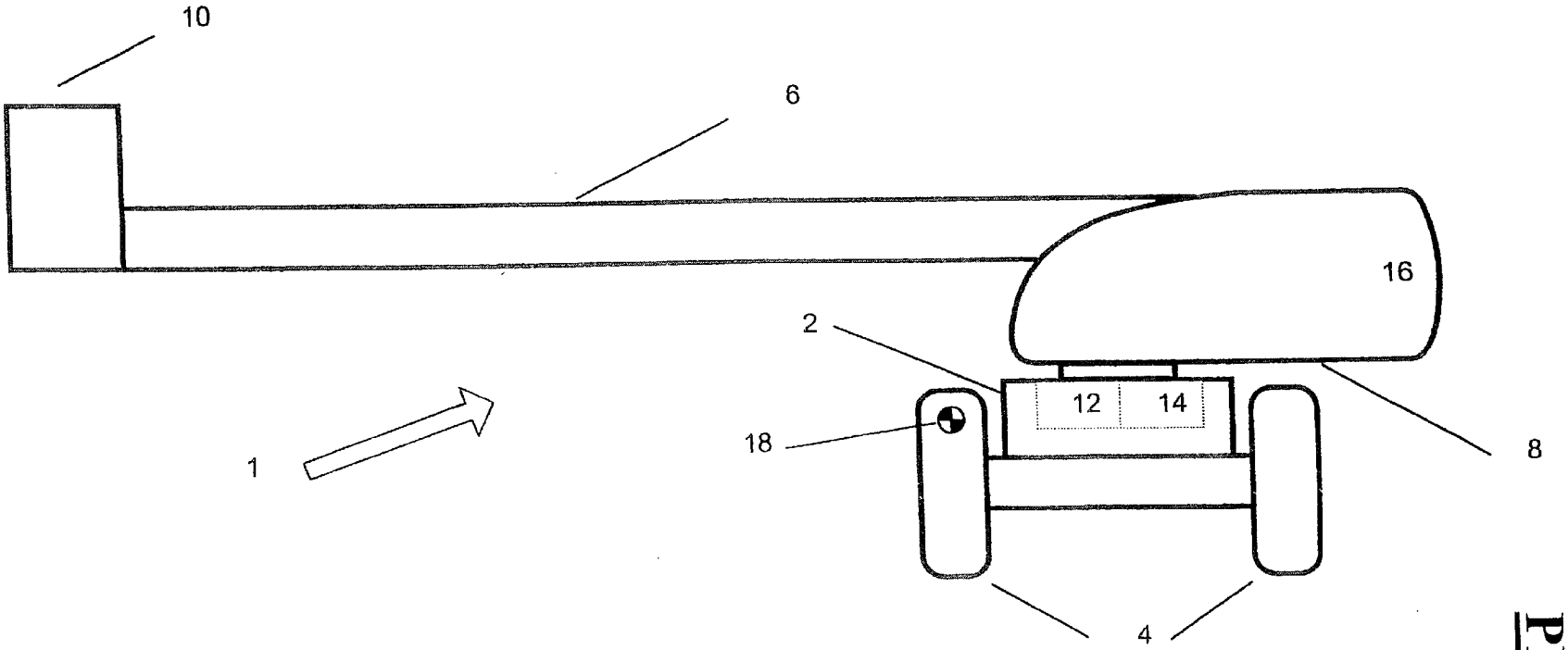
FIG. 2*b* is essentially the same view as FIG. 1, illustrating the boom of the lift structure in a significantly lowered position.
Figure 2C:
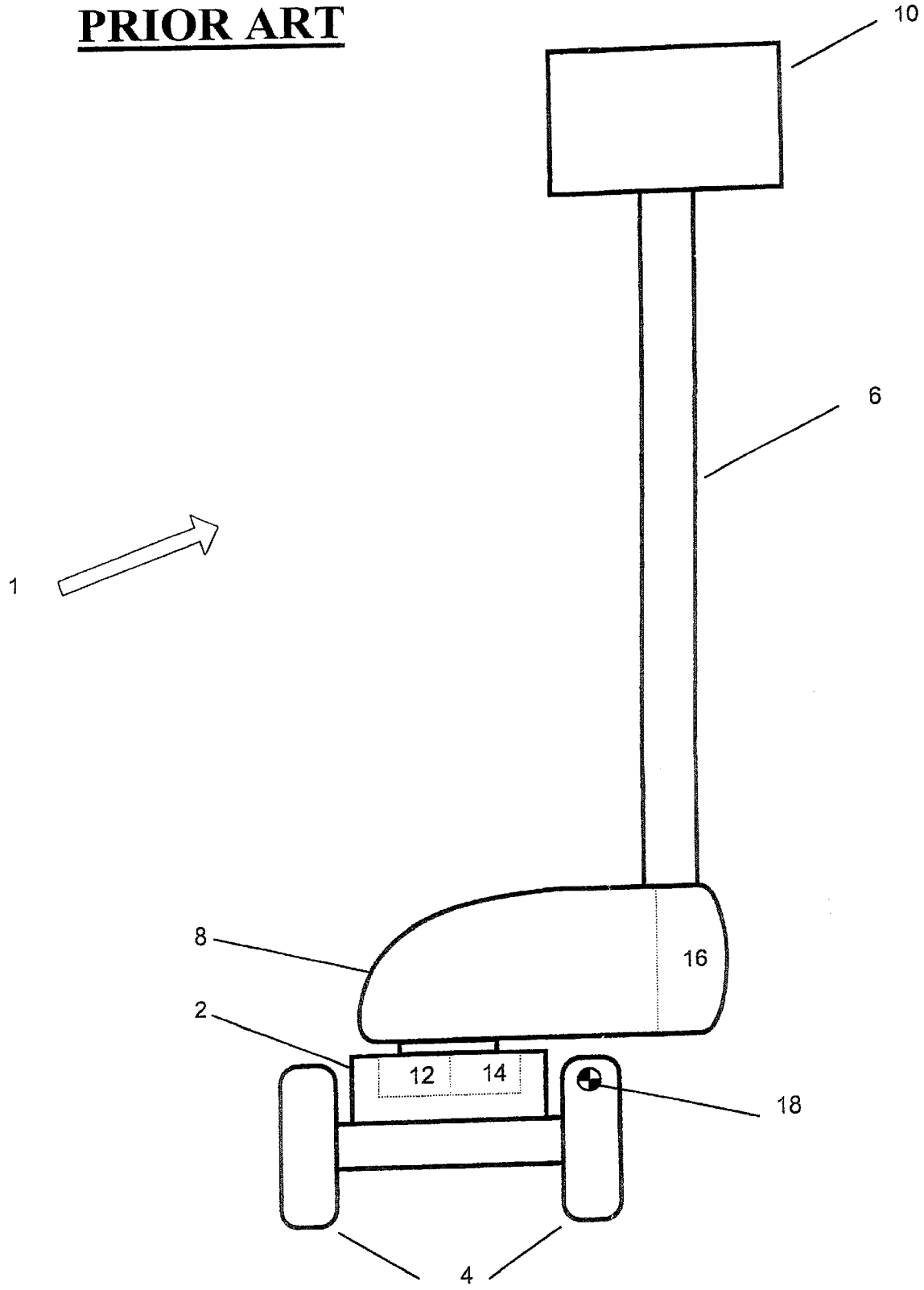
FIG. 2*c* is essentially the same view as FIG. 1, illustrating the boom of the lift structure in a significantly raised position.

FIGS. 1–2*c* are schematic representations of boom lifts that are intended to convey some basic concepts relating to lift stability. As such, it is to be understood that FIGS. 1–2*c* are not necessarily to scale and that the dimensions, proportions and positional relationships illustrated therein might be exaggerated or diminished simply to assist in illustrating such basic concepts. Furthermore, FIGS. 1–2*c* relate to "single boom" or "telescoping boom" arrangements and, although the present invention, in accordance with at least one presently preferred embodiment, relates to articulated booms and possibly even multi-segmented tower booms, it is to be understood that basic concerns relating to stability discussed herebelow with reference to FIGS. 1–2*c* are similarly applicable to articulated booms or multi-segmented booms. FIG. 1 schematically illustrates a typical boom lift 1. As is known conventionally, a chassis 2 is supported on wheels 4. Conceivable substitutes for wheels 4 might be tracks (similar to the type found in a military tank), skids or possibly even "outriggers" as known in the industry (i.e., components that can selectively extend outwardly from the chassis to provide a broader base of support for the lift). A boom 6, extending from turntable 8, will preferably support at its outer end a platform 10. Turntable 8 (often termed the "superstructure") may preferably be configured to effect a horizontal pivoting motion, as indicated by the arrows, in order to selectively position the boom 6 at any of a number of circumferential positions lying along a horizontal plane. There is preferably a drive arrangement 12 (such as a slew or swing drive) to effect the aforementioned horizontal pivoting motion. On the other hand, there is also preferably provided a drive arrangement 14 (such as a lift cylinder) for pivoting the boom 6 along a generally vertical plane, to establish the position of boom 6 at a desired vertical angle a. The drive arrangements 12 and 14 could be operationally separate from one another or could even conceivably be combined into one unit performing both of the aforementioned functions.

Preferably, the turntable 8 will include, in one form or another, a counterweight 16. Such counterweights are generally well known to those of ordinary skill of the art, as discussed in the "Background" section of this disclosure. In the illustrated example, counterweight 16 is a dedicated component that actually forms a portion of an outer shell of turntable 8. Preferably, the counterweight 16 will be positioned, with respect to the turntable 8, substantially diametrically opposite the boom 6.

In this respect, FIGS. 2*a*, 2*b* and 2*c* schematically illustrate the manner in which such a counterweight 16 conventionally acts. Although a conventional counterweight will act in similar manner irrespective of the relative circumferential positioning (i.e., the "swing" or "slew") of boom 6 with respect to chassis 2, FIGS. 2*a*–2*c*, in similar manner to FIG. 1, illustrate the boom positioned at a horizontal angle of 90° with respect to the longitudinal lie of the lift 1, that is, orthogonal to a direction that defines the drive direction of the lift 1. The reason for illustrating the lift 1 in this manner is that, since this position naturally invites the most unstable configurations for a boom lift 1 where the dimension (i.e., along the drive direction) of the lift is greater than the lateral dimension, the action of counterweight 16 will be better appreciated. Put another way, this is a typical configuration of maximal instability in that the boom lies along a horizontally mapped line that itself is perpendicular to the tipline.

FIG. 2*a* illustrates the boom 6 in an "intermediate" position, in this case approximately 40 degrees from the horizontal. On the other hand, FIG. 2*b* illustrates the boom being positioned substantially horizontally, while FIG. 2*c* illustrates the boom being positioned substantially vertically.

FIGS. 2*b* and 2*c* represent possible extremes of boom elevation, especially as regard the generation of destabilizing moments. In practice, a boom angle below the horizontal is quite common.

Accordingly, the two extremes shown in FIGS. 2*b* and 2*c* typically represent the positions in which a typical boom lift will experience maximum forward and backward instability (as a function of boom angle), respectively. (Although many boom lifts do not elevate as far as a vertical angle of 90 degrees, such an angle is shown in FIG. 2*c* in order to illustrate an extreme position of possible backward instability. The notion of a vertical angle of greater than 90 degrees is not entertained here, as such an angle could be duplicated by changing the boom's horizontal angle by 180 degrees and fixing the boom at a vertical angle of less than 90 degrees.)

With regard to forward instability, as illustrated in FIG. 2*b*, it will be noted that the extreme outward positioning of platform 10 will naturally contribute to a maximal forward destabilizing moment. One benefit of providing the counterweight 16, then, is to counterbalance this forward destabilizing moment so as to prevent the lift's center of mass 18 from migrating outside "tipline", which would otherwise result in forward tipping. It will be appreciated, then, that it is possible to provide a sufficiently massive counterweight 16 as to adequately counterbalance the maximal destabilizing moment experienced in accordance with the configuration shown in FIG. 2*b*, and to do so in such a manner as to fulfill any requirements (e.g., to account for the presence of one or more individuals on the platform 10, for the positioning of the entire lift vehicle 1 on a given slope, and/or for a required margin of safety).

Turning to FIG. 2*c*, however, it will be appreciated that when the boom 6 is in a maximally vertical position, the risk of significant backward instability will now present itself. Particularly, given that a counterweight 16 is provided for the purposes described heretofore, it will now unfortunately have the opposite effect, that is, of contributing to instability of the vehicle in a backward direction.

For this reason, it will be appreciated that an appropriate counterbalance for the counterweight, and one which has been used conventionally, is the chassis 2 itself. For this reason, it has been conventional to construct a chassis 2 of such mass as to adequately counterbalance the destabilizing moment provided in the backward direction (possibly contributed to by boom 6, platform 10 [possibly with a load thereon] and counterweight 16), to again prevent the lift's center of mass 18 from migrating outside the tipline, which would otherwise result in backward tipping.

At least one presently preferred embodiment of the present invention is believed to address admirably problems relating to stability, and others, as discussed herebelow.

It will be appreciated that the inventive arrangements described and illustrated herein, with relation to at least one presently preferred embodiment, need not necessarily be restricted to the context of a "tower boom" and an "upper boom". Indeed, the same principles could be applied, for example, to the context of a two-segmented tower boom or any two movable booms or load-bearing arms or segments in essentially any load-bearing apparatus.

Figure 3:
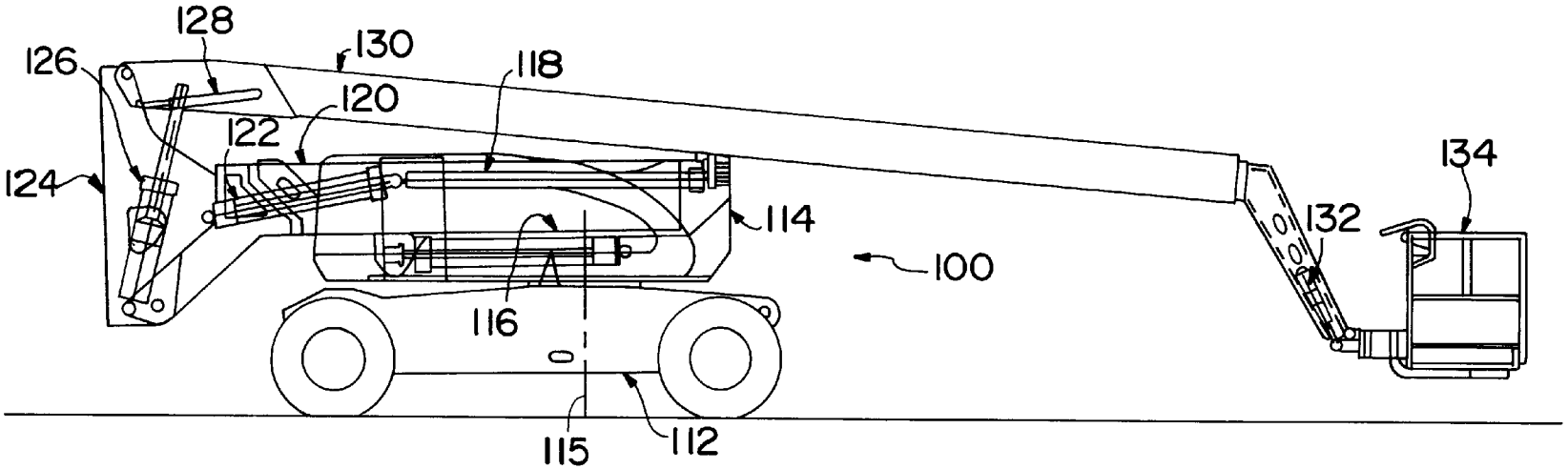
FIG. 3 illustrates a boom lift in side elevational view.

FIG. 3 illustrates, in elevational view, a boom lift 1 in accordance with at least one presently preferred embodiment of the present invention. More detailed descriptions of several components illustrated in the accompanying figures, including the master and slave cylinders and their interconnecting circuitry, may be found in U.S. Pat. No. 4,775,029 to MacDonald et al.

As is known typically, lift 1 preferably includes a wheeled chassis 112, upon which is mounted a rotating structure 114 for positioning the boom structure of boom lift 1 in a circumferential direction about rotational axis 115. Such a rotating structure 114 is often known as a "turntable" and can include, among other things, a dedicated counterweight for assisting in the counterbalancing of the boom structure, conceivably similar to that described above with respect to FIGS. 1–2*c*. Dedicated counterweights of this ilk are generally well-known to those of ordinary skill in the art, and will thus not be described in any greater detail herein.

Two cylinders, indicated at 116 and 118, preferably assist in the movement and extension of tower boom 120, or a lowermost portion of the boom structure. Particularly, cylinder 116 preferably serves to raise tower boom 120 to a selected range of vertical angles, while cylinder 118 is preferably utilized to telescope a portion of tower boom 120 in a direction parallel to the longitudinal dimension of the tower boom 120. The telescoping feature of tower boom 120 is of course not present in all boom lifts, but it is believed that the present invention, in accordance with at least one presently preferred embodiment, advantageously does not preclude the use of such telescoping tower booms.

Indicated at 122 is a cylinder that serves to displace upright 124. Primarily, this cylinder 122, connected between tower boom 120 and upright 124, serves to maintain the upright 124 in its essentially straight, vertical orientation as shown in FIG. 3, regardless of the orientation of other parts of the boom structure. This type of cylinder is used conventionally and is disclosed, for example, in the U.S. patent to MacDonald et al. mentioned heretofore.

In accordance with a presently preferred embodiment of the present invention, a cylinder 126 employed for raising upper boom 130 is pinned on a portion of tower boom 120 (as well as on upper boom 130 itself). This provides a marked contrast with respect to other conventional arrangements, in which such a cylinder (hereinafter referred to as the "upper lift cylinder") is pinned between an upper boom and an upright.

Figure 4:
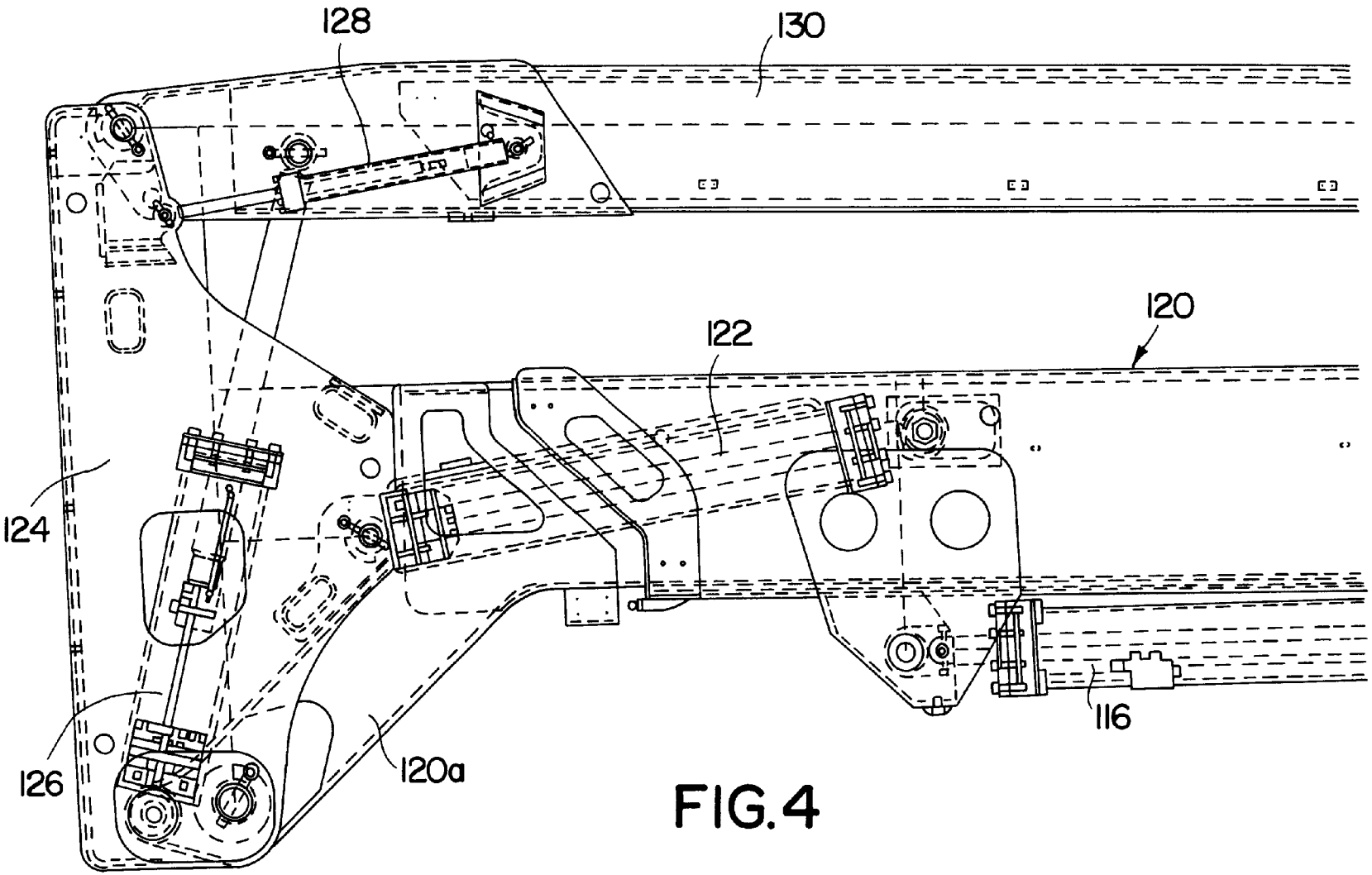
FIG. 4 is a close-up elevational view of several components of a boom lift, including an upright.

Preferably, and with reference to FIG. 4, the upper lift cylinder 126 may be pinned on a protruding portion 120*a* of tower boom 120 that is commonly known as the "fly nose". In this manner, the upper lift cylinder 126 is effectively pinned to a portion of the tower boom 120 itself, while the dimensions of fly nose 120*a* can preferably be tailored to provide the best possible range of action and performance of upper lift cylinder 126. A preferred dimensioning of fly nose 120*a* is shown in FIG. 4, but it is to be understood that the present invention need not necessarily be restricted to such an arrangement.

Referring to FIG. 3, a master cylinder 128 may preferably be provided, in known manner, between upright 124 and upper boom 130, as well as a slave cylinder 132 between upper boom 130 and work platform 134. The operation and interaction of master cylinder 131 and slave cylinder 132 may be better understood, as a non-restrictive example, in the disclosure of the aforementioned patent to MacDonald et al.

FIG. 4 illustrates a close-up view of upright 124 and other components in that vicinity, in order to afford a better understanding of the various components, and their interrelationship, that may be utilized in accordance with at least one presently preferred embodiment of the present invention.

Figure 5:
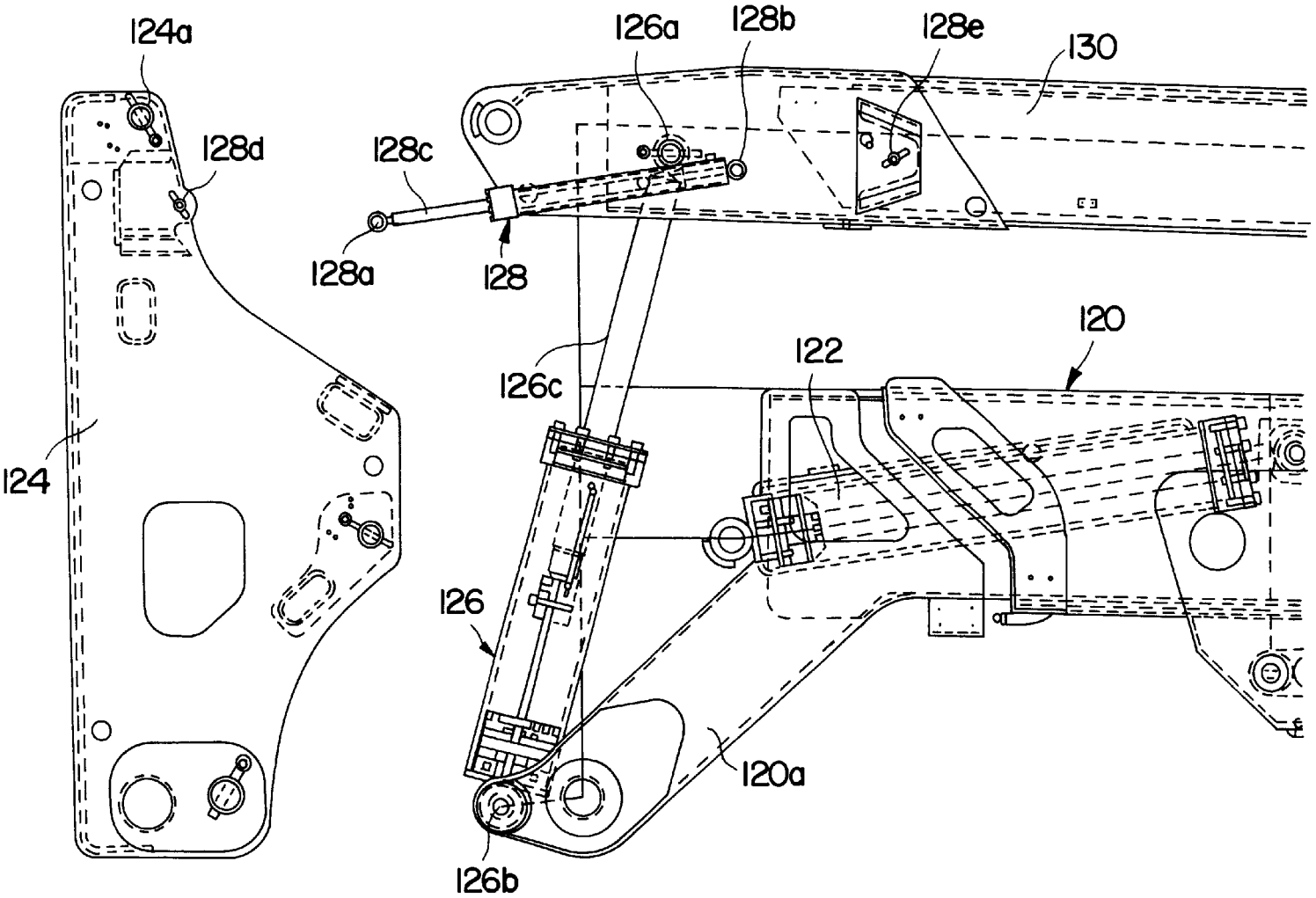
FIG. 5 is essentially the same view as FIG. 4 but illustrating several components in exploded fashion.

FIG. 5 is essentially the same view as FIG. 4, but shows some components in exploded fashion. As shown, upper lift cylinder 126 may preferably include a first connection medium 126*a*, for connection at upper boom 130; a second connection medium 126*b*, for connection at tower boom fly nose 120*a*; and a rod 126*c* for displacing upwardly to increase the vertical angle of upper boom 130 with respect to the horizontal.

Master cylinder 128 is shown as including a first connection medium 128*a*, for connection at upright 124 (at hinge point 128*d* thereof); a second connection medium 128*b*, for connection at upper boom 130 (at hinge point 128*e*); and a rod 128*c*. Also shown is a pivot point 124*a* on upright 124 for permitting the pivoting motion of upper boom 130.

In known manner, master cylinder 128 will preferably sense changes in the angle of upper boom 130 with respect to the horizontal. Preferably, in known manner, the sensed changes of angle will be communicated to the slave cylinder 132 (see FIG. 3) in order to keep the work platform 134 level irrespective of the changing angle of the upper boom 130. Additionally, a lower system of master and slave cylinders may preferably be utilized to keep the upright 124 level (i.e., in plumb) irrespective of the changing vertical angle of the tower boom 130. In this case, the tower boom lift cylinder 116 would act as a master cylinder while cylinder 122 would act as a slave cylinder, in that tower boom lift cylinder 116 would sense changes of angle in tower boom 120 and communicate such information to cylinder 122, with the result of keeping upright 124 level. Conceivable modes of operation of such master cylinders and slave cylinders is discussed in more detail in U.S. Pat. No. 4,775,029 to MacDonald et al.

Figure 6:
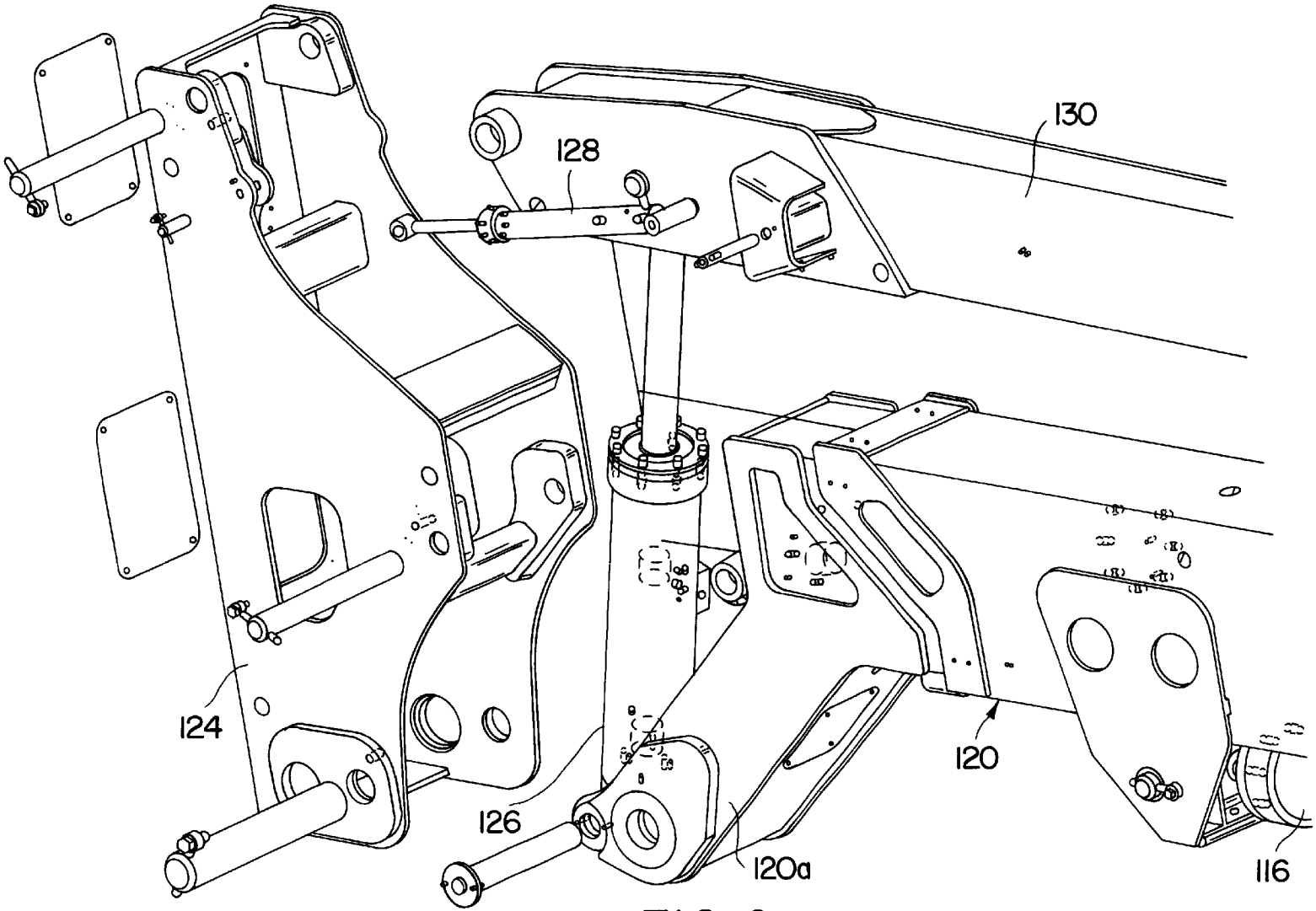
FIG. 6 is a perspective exploded view of a boom lift upright and other components.
Figure 7:
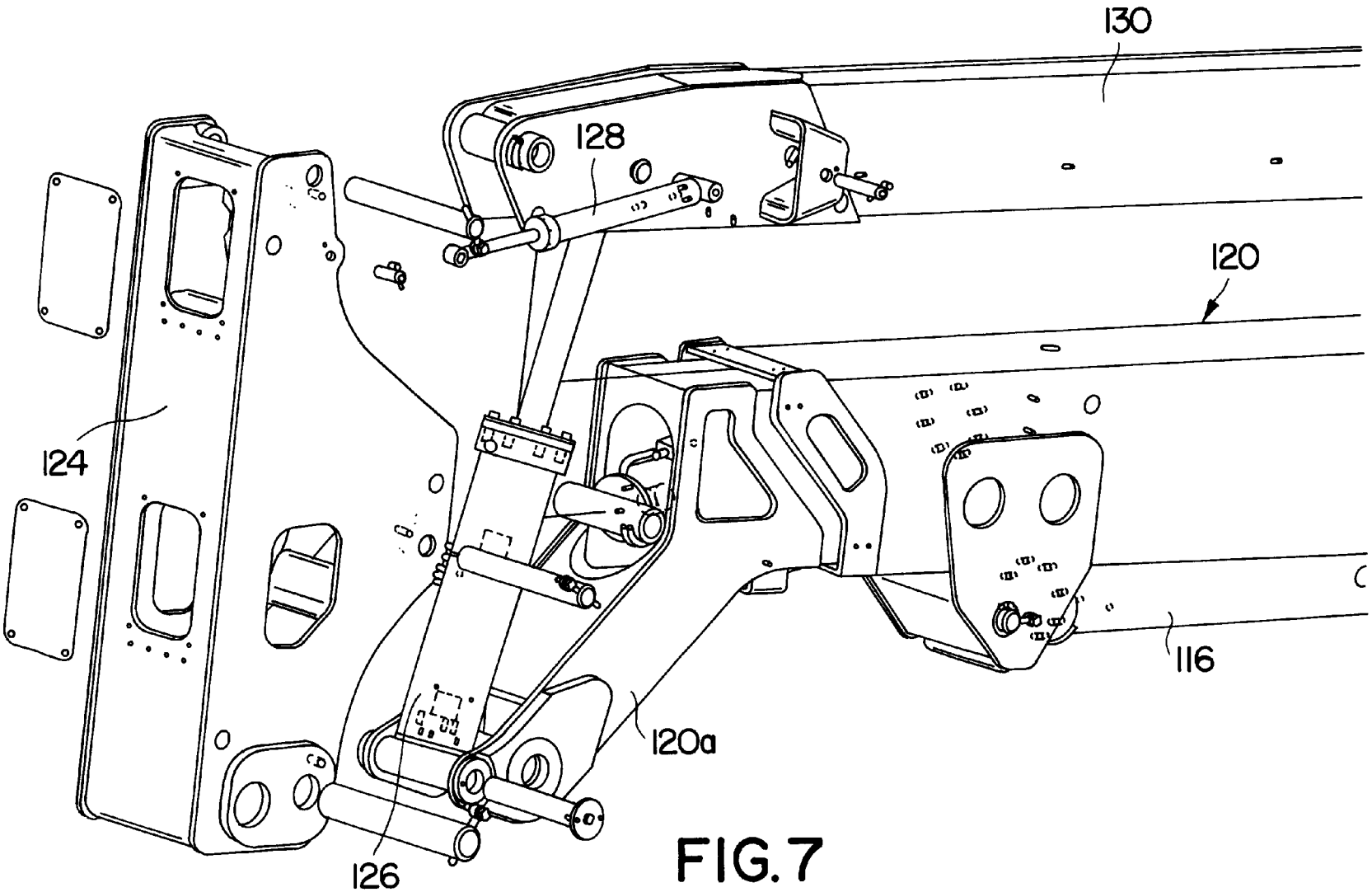
FIG. 7 is a perspective exploded view substantially similar to FIG. 6 but from a different angle.

FIGS. 6 and 7 illustrate perspective exploded views of the arrangement shown in FIG. 4. Similar components have similar reference numerals as described above. It will be appreciated from FIGS. 6 and 7 that upper lift cylinder 126 can essentially be contained within the structure defined by upright 124, upper boom 130 and tower boom 120, in that it needs not be pinned on the outside of these components. This can potentially represent a tremendous advantage by saving space and by protecting upper lift cylinder 120 from external elements. Furthermore, the positioning of the upper lift cylinder 126 within the upright 124 and booms (120,130) permits a greater range of motion of the booms than would be possible if the cylinder 126 were mounted externally, since there will be no "tangle" of external components that might hamper such motion. Thus, the result is that the packaging of components is facilitated while simultaneously permitting a range of relative boom motion similar to that found in some known arrangements in which the booms are mounted side-by-side with respect to one another for the purpose of increasing boom motion.

Figure 8B:
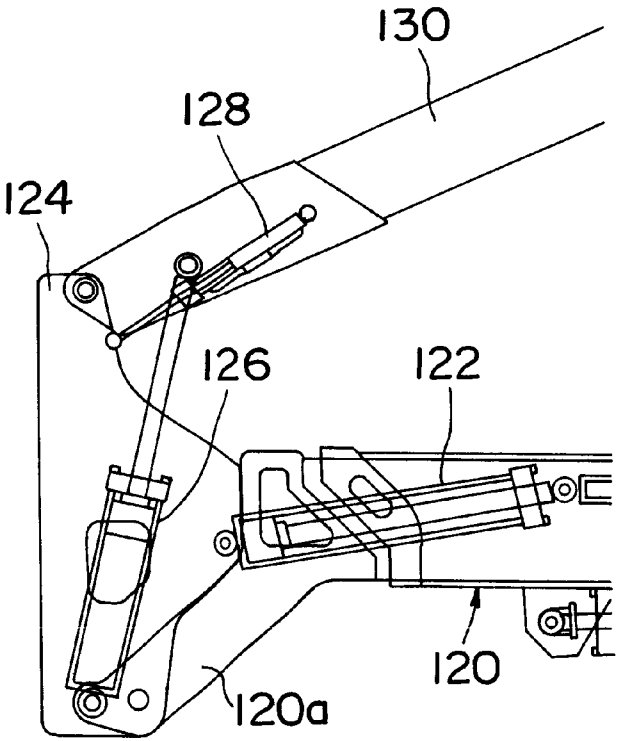
FIGS. 8*a*–8*e* illustrate elevational views of various orientations of a tower boom and upper boom.
Figure 8A:
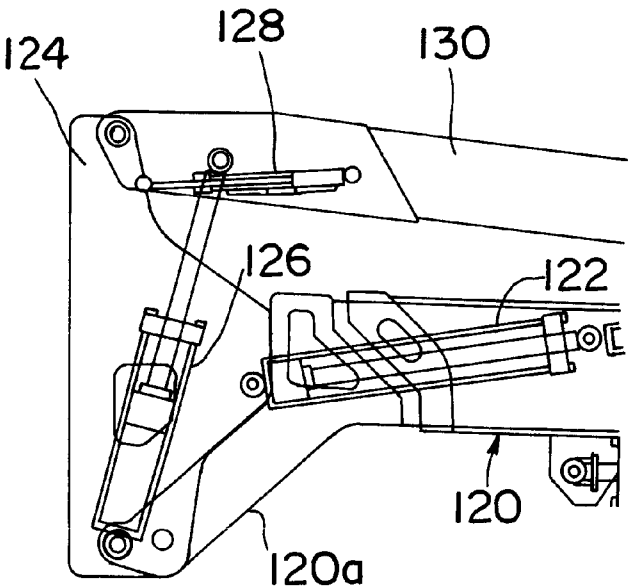
Figure 8E:
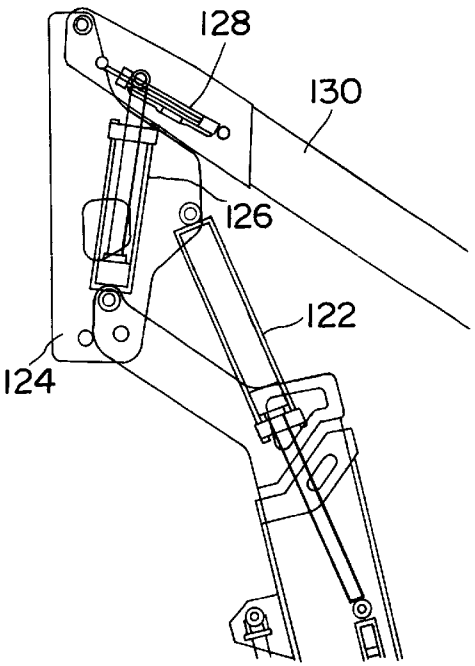
Figure 8D:
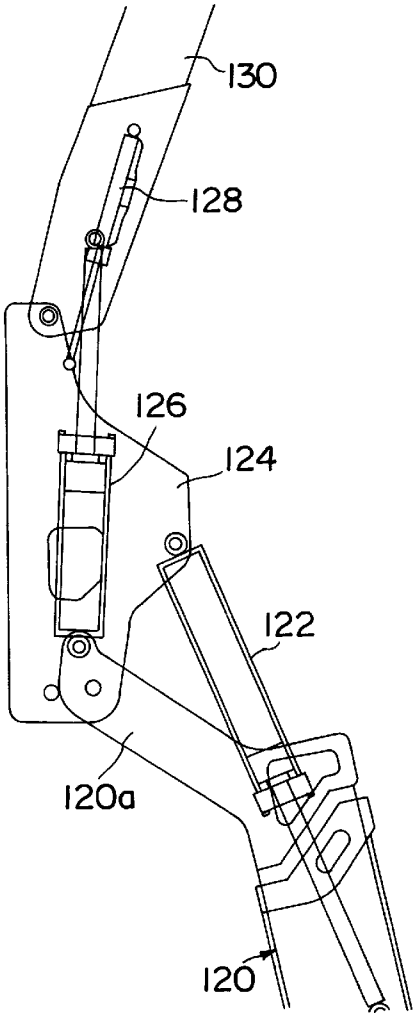
Figure 8C:
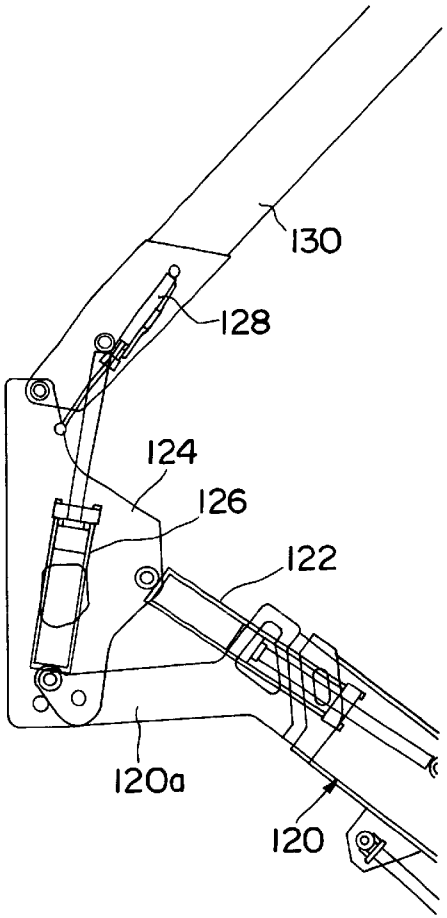

FIGS. 8*a*–8*e* illustrate various positions that may be attained in accordance with at least one presently preferred embodiment of the present invention. Thus, FIG. 8*a* shows the booms (120, 130) in stowed position, FIG. 8*b* shows the upper lift cylinder 126 fully extended when the tower boom 120 is stowed, FIG. 8*c* shows the tower boom 120 raised to an intermediate position with the upper lift cylinder 126 fully extended, FIG. 8*d* shows the tower boom raised to its highest possible position (with the upper lift cylinder 126 fully extended), and FIG. 8*e* shows the tower boom 120 in its highest position, but with the upper lift cylinder 126 fully retracted.

It will be appreciated from FIGS. 8*a*–8*e* that at least one presently preferred embodiment of the present invention permits a range and variety of movement that is generally found to be lacking in conventional structures. The rapid raising of both the tower boom 120 and the upper boom 130 simultaneously, via use of the lower lift cylinder 116 can be appreciated with reference to FIGS. 8*b*–8*d*. It will also be noted that simultaneous action of both lift cylinders 116 and 126 can allow the work platform (not shown) to further rapidly increase its vertical distance from the ground.

It is to be appreciated that the total angle (with respect to the horizontal) attained by the upper boom 130 is, in accordance with at least one presently preferred embodiment of the present invention, represented by a sum of what may be termed a "mechanical" component and a "hydraulic" component. The "mechanical" component is represented by that increase in vertical angle that is prompted by the increasing vertical angle of the tower boom 120 which, owing to the connection points of upper lift cylinder 126 contemplated herein, results in the use of upper lift cylinder 126 as a de facto mechanical link, albeit one of infinitely variable length. In other words, upper lift cylinder 126 acts in the manner of a mechanical link while it is held steady at a given degree of extension of its rod, but since the position of the rod can be changed, this de facto mechanical link can assume essentially any length within the bounds of the available stroke length of cylinder 126.

The "hydraulic" component is represented by that change in vertical angle that is prompted directly by the extension or retraction of upper lift cylinder 126 itself. Thus, it will be appreciated that the present invention, in accordance with at least one presently preferred embodiment, affords a degree of flexibility and versatility that apparently has been hitherto unrealized by most known arrangements. For example, it is conceivable to lower the upper boom 130 via retraction of the upper lift cylinder 126 even while the tower boom 120 is being raised and the "mechanical" component is still being asserted. Perhaps more importantly, the "mechanical" and "hydraulic" components of motion would appear, in accordance with at least one presently preferred embodiment of the present invention, to lend themselves to a very wide range of possible movements afforded by either component of movement alone or the two components in combination. The possible permutations represented by the available combinations of "mechanical" and "hydraulic" movements are potentially vast and would appear to afford a hitherto unrealized degree of versatility, flexibility and, perhaps most importantly, controllability.

FIGS. 8*d* and 8*e* illustrate a particular measure of versatility found in a boom lift according to at least one presently preferred embodiment of the present invention. Particularly, with the tower boom 120 fully raised, the upper lift cylinder can be positioned into a wide range of positions, from full extension (FIG. 8*d*) to full retraction (FIG. 8*e*), thus permitting the upper boom to assume a wide range of possible positions. This is in marked contrast with those known arrangements in which, for example, there is complete interdependence between the position of a first boom or boom segment and a second boom or boom segment pivotally attached thereto (such as in the case of a two-segmented tower boom).

Since the present invention, in accordance with at least one presently preferred embodiment, permits the use of a telescoping tower boom 120, attendant advantages found in conjunction therewith might also be enjoyed. For example, the highly desirable "up and over" capability that is often of great importance in the industry, will be improved upon. More particularly, a telescoping tower boom 120 precludes the need for either a long (fixed) tower boom or a long upper boom to achieve a given maximum elevation of the work platform 134 (see FIG. 3). For instance, with a long fixed tower boom, the stowed length not only increases but the potential for backward instability increases as well. With a long upper boom, horizontal outreach might increase undesirably to the point that the potential for forward instability increases. Many known arrangements, such as those involving parallelogram linkages, do not readily lend themselves to the use of a telescoping tower boom and thus will inherently lack the advantages that might be attained with a telescoping tower boom.

In accordance with at least one embodiment of the present invention, it will be appreciated that the capability is provided of imparting an extensive range of "hydraulic" motion that might otherwise be absent. For example, it will be appreciated from FIG. 8*a* that, in the stowed position, the cylinder 126 is not fully retracted. Indeed, it is conceivable that the available stroke length of cylinder 126, from that departure point, is sufficient to attain "full height" of the two booms (FIG. 8*d*). As the tower is raised, however, the available range of motion of the upper boom is increased, owing to the increased available stroke length of the cylinder 126. Thus, when the tower is fully raised, as in FIGS. 8*d* and 8*e*, an extensive range of motion is available for the upper boom 130, as provided for by the full stroke length of cylinder 126.

More generally, it will be appreciated that the present invention, in accordance with at least one presently preferred embodiment, permits a broad spectrum of possible customization of the "mechanical" and "hydraulic" components of boom motion mentioned heretofore, to allow for a wide variety of machines with a similarly wide variety of potential uses. For example, the geometry and dimensions of the tower and upper booms, of the upright, of their pivot points and of the cylinders connecting them, can be tailored in order to provide a desired pattern or algorithm of "mechanical" (i.e. "dependent") motion. On the other hand, the characteristics of the upper lift cylinder can be similarly tailored to provide a desired pattern or algorithm of "hydraulic" (i.e. "independent") motion. By tailoring the pertinent physical parameters in this manner, a wide range of mechanical algorithms, having "mechanical" and "hydraulic" components, are attainable, each of which may have its own inherent advantages and uses.

Figure 9:
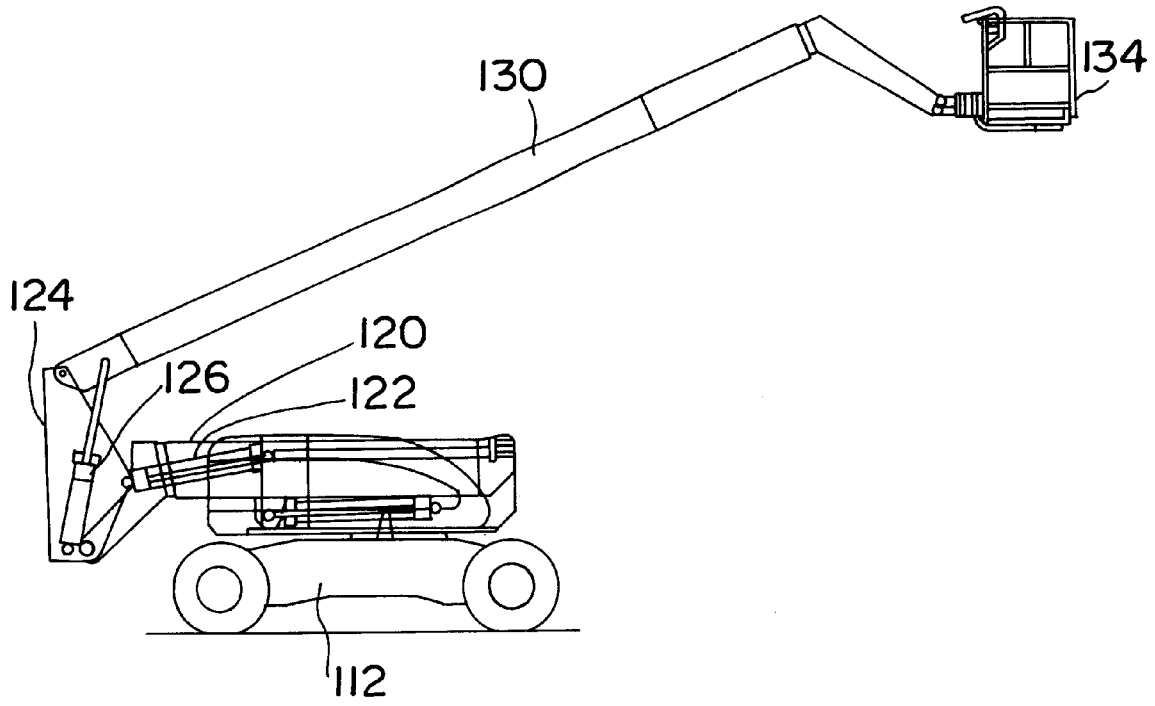
FIG. 9 is a side elevational view of a boom lift with the boom structure in an intermediately raised position, as in FIG. 8*b*.
Figure 10:
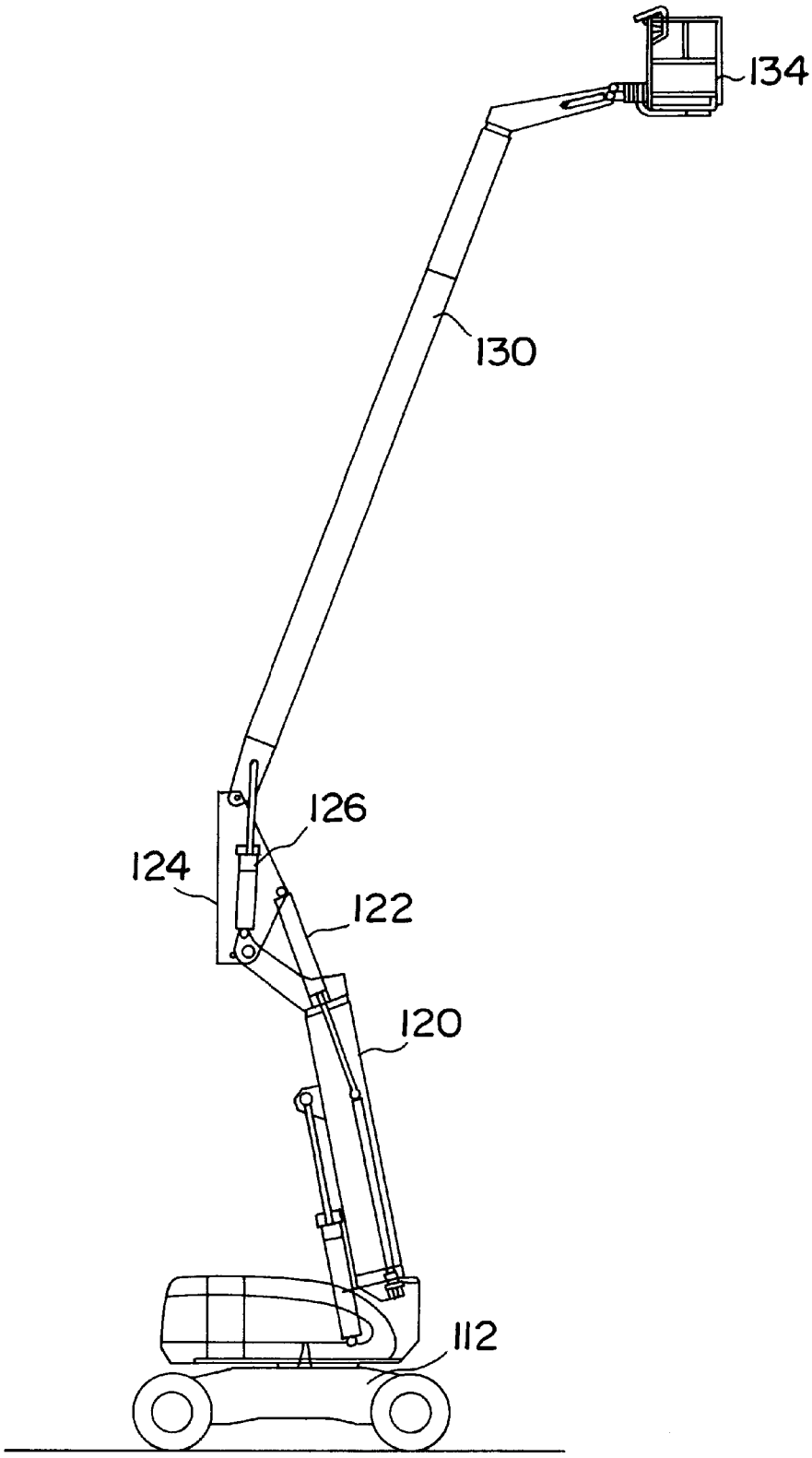
FIG. 10 is a side elevational view of a boom lift with the boom structure in an maximally raised position, as in FIG. 8*d*.

FIGS. 9 and 10 show the entire lift in various positions. Particularly, FIG. 9 shows the boom lift 1 in an orientation wherein the tower boom is stowed but the upper lift cylinder is fully extended, while FIG. 10 illustrates a boom lift 1 in an orientation wherein the tower boom is fully raised and the upper lift cylinder is fully extended. In both cases, it will be appreciated that the platform 134 and upright 124 remain level both with respect to one another and to the horizontal. Preferably, this may be brought about by utilizing the master and slave cylinders similar to those discussed in U.S. Pat. No. 4,775,029 to MacDonald et al. It will be appreciated that several known arrangements, including the "Condor" arrangement discussed in the "Background" section of this disclosure, do not even lend themselves to the use of master and slave cylinders since their placement might not even be permitted in the first place, thus adding another apparently hitherto unrealized degree of versatility to at least one presently preferred embodiment of the present invention.

It is to be understood that the present invention need not necessarily be restricted to the use of hydraulic cylinders for performing the functions discussed herein. Indeed, it is conceivable to utilize other media for raising different portions of a boom, including: a chain, cable or belt drive; a lead-screw actuator; rotary actuators at appropriate pivot points (e.g. an appropriately configured and positioned gear train) ; and even a four-bar parallelogram structure for maintaining the upright 124 in level position, whereby an upper lift cylinder 126 could be pinned at the upper end of the parallelogram.

From the foregoing, it will be appreciated that at least one presently preferred embodiment of the present invention broadly contemplates a customizable load-bearing apparatus in which at least one component is provided for imparting a predetermined dependent relationship and a predetermined independent relationship between a first boom portion and a second boom portion. In accordance with at least one presently preferred embodiment of the present invention, the at least one component includes a structure, such as the cylinder 126 described heretofore, that is capable of simultaneously serving as a link for dependently transmitting a motive force from the first boom portion to the second boom portion while simultaneously providing for independent movement of the second boom portion with respect to the first boom portion.

In an advantageous refinement of at least one presently preferred embodiment of the present invention, the aforementioned link is connected between the first boom portion and the second boom portion. As a non-restrictive example of this, the lift cylinder 126 may be pinned to the flynose 120*a* of a lower boom 120, as described heretofore.

In another advantageous refinement according to at least one presently preferred embodiment of the present invention, the aforementioned at least one component can be selectively dimensioned and mounted with respect to the first and second boom portions so as to selectively impart a predetermined algorithm of motion, having "dependent" and "interdependent" components, to the first and second boom portions. In an advantageous refinement of this concept, the aforementioned at least one component preferably includes a link connected between the first boom portion and the second boom portion and preferably is capable of directly transmitting a motive force from the first boom portion to the second boom portion while also being separately capable of moving the second boom portion independently of the first boom portion.

In another advantageous refinement according to at least one presently preferred embodiment of the present invention, the motive algorithm imparted to a load bearing apparatus may restrict the "independent" capability of the aforementioned at least one component as a function of the position of the first boom portion. In other words, the degree to which the second boom portion is independently movable with respect to the first boom portion can itself advantageously be governed as a function of the position of the first boom portion. A non-restrictive example of this has been described heretofore, in that cylinder 126 may enjoy an increasing available stroke length (i.e., a stroke length available for independently moving upper boom 130 with respect to tower boom 120) as tower boom 120 is raised.

Some advantages that have been observed in accordance with a presently preferred embodiment of the present invention are recapitulated herebelow:

Backward stability considerations of the machine are important if the tower boom is in a nearly stowed position with the upper boom fully raised. If the upper boom angle is limited while the tower boom 120 is in the nearly stowed position, overall counterweight requirements, including requirements relating to the weight of the chassis, are reduced, thereby improving the cost and performance of the lift. However, it will be appreciated that this limitation of upper boom movement, as discussed below, does not carry over to other positions of the tower boom.

More to the point, in at least one embodiment of the present invention, the upper boom motion is comprised of the mechanical motion gained by the tower boom movement and the hydraulic movement of the upper lift cylinder. When the tower boom is at a given vertical angle, the upper boom position is limited to the motion achieved by the hydraulic movement of the upper boom lift cylinder. With low vertical angles of the tower boom, the motion of the upper boom, as dictated by the upper lift cylinder, is restricted so as to optimize backward stability of the machine. As the tower boom is raised, the upper boom thus automatically obtains a greater range of movement, since the potential for backward instability decreases with the increasing of the tower boom angle (i.e., the continual "forward" motion of the center of mass of the composite boom structure). Thus, it is to be appreciated that, in accordance with at least one presently preferred embodiment of the present invention, an inherent safeguard against backward instability can be provided by restricting movement of the upper boom when the tower boom is in lower positions (i.e., the composite boom structure's center of mass is positioned further "backward") and permitting increased movement of the upper boom when the tower boom is in higher positions (i.e. the composite boom structure's center of mass is positioned further "forward").

In accordance with at least one presently preferred embodiment of the present invention, it will be appreciated that although the interdependent (i.e. "dependent") relationship of the tower boom with respect to the upper boom might eliminate some possible positionings of the composite boom structure, many of the positionings so eliminated correspond to those that would in any case invite undesirable backward instability. By eliminating such positions of potential backward instability, it is possible to accord the chassis or other main frame structure a reduced weight, thus saving on manufacturing costs and providing other attendant advantages.

As another advantage in accordance with at least one presently preferred embodiment of the present invention, due to the motion gained by the mechanical linkage of the upper boom to the tower boom, the hydraulic motion of the upper boom required to achieve full elevation is reduced. Particularly, a significant portion of the angular change required for the upper boom to achieve full elevation is gained automatically through the movement of the tower boom. Also, as lifting time is a function of hydraulic movement, the time to lift is significantly reduced.

Also, in a conventional arrangement in which the upper boom changes angle independently of the tower boom, while raising the tower boom (and simultaneously freezing the independent movement of the upper boom), the "sweep" of the platform is essentially a portion of the circumference of the radius created by the tower boom movement. This movement of the platform becomes nearly horizontal at high tower angles, yet such horizontal movement may not be desirable for the operator while he or she is in the process of raising the boom. Similar movements will also take place if the upper boom is moved independently of the tower boom, although the direction of the arc will be essentially opposite that described when the upper boom is frozen in position and the tower boom moves.

With a boom arrangement according to at least one presently preferred embodiment of the present invention, however, the upper boom changes angle relative to the tower boom while the tower boom is being raised, owing to the "mechanical" component of motion, or "dependent" motion, discussed heretofore. As a result, the net horizontal motion of the platform tends to be counteracted by the opposite angular motions of the two booms. However, in contrast to several known arrangements, the present invention, in accordance with at least one presently preferred embodiment, affords the possibility of overriding the change in upper boom angle provided by the "dependent" relationship with the tower boom and instead controlling the upper boom motion independently via hydraulic motion of the upper lift cylinder.

As discussed heretofore, at least one presently preferred embodiment of the present invention permits the use of master and slave cylinders, whereas this capability might not be possible in some known arrangements.

It will be appreciated that the present invention, in accordance with at least one presently preferred embodiment, affords advantages specific to each of a wide variety of possible applications. For example, if issues of stability are not of particular concern, it will be appreciated that the present invention, in accordance with at least one presently preferred embodiment, affords tremendous versatility in the possible positions of an articulated boom arrangement or other similar lifting device. Other advantages that can be attained are: multiplied motion derived from a single cylinder (e.g., upper lift cylinder 126), in that one component, in this case the cylinder, is capable of simultaneously transmitting the "dependent" and "independent" motion described heretofore; virtually vertical platform travel (in conjunction with the "canceling out" of the arcs described by the upper and tower booms, as described previously); and rapid deployment of the upper boom; among many other possible advantages that can be attained.

Whereas many known arrangements purely address the issue of stability and thus are configured in a manner that might afford a highly restricted work envelope, the present invention, in accordance with at least one presently preferred embodiment, does not presuppose that a single issue, such as stability, is of primary or paramount importance, and indeed permits the customization of lift structures or other load-bearing apparatus in a manner appropriate to the intended use of the apparatus. It will thus also be appreciated that many presently unforeseen advantages can be attained by way of the vast spectrum of customization that can be afforded in accordance with at least one presently preferred embodiment of the present invention.

In industries other than the boom lift industry, there conceivably exist certain requirements and objectives that differ from those inherent in the boom lift industry, and it is to be understood that the present invention, in accordance with at least one presently preferred embodiment, is sufficiently versatile and wide-ranging as to address such requirements and objectives as they arise. For example, in a front-end loader, it is conceivable to utilize a cylinder or other driving device similar in function to the upper lift cylinder 126 discussed herein, in that dependent upward motion of the bucket could be obtained with the cylinder or driving device acting as a pure mechanical link, while the same cylinder or driving device could be used to selectively tip the bucket independently of the arm supporting it.

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

It should be appreciated that the apparatus and method of the present invention may be configured and conducted as appropriate for any context at hand. The embodiments described above are to be considered in all respects only as illustrative and not restrictive. The scope of the invention is defined by the following claims rather than the foregoing description. All changes which come within the meaning and range of equivalency of the claims are to be embraced within their scope.

What is claimed is:

1. Load-bearing apparatus comprising:

a reference portion;

a first arm portion extending from said reference portion and being pivotally displaceable with respect thereto;

a second arm portion being pivotally displaceable with respect to said first arm portion;

an upright directly interconnecting said first and second arm portions; and at least one displacing element, directly interconnecting said first and second arm portions, for:

serving as a mechanical link for passively transmitting a motive force from said first arm portion to said second arm portion; and selectively moving said second arm portion independently with respect to said first arm portion;

whereby an angle defined by said second arm portion with respect to the horizontal increases as an angle defined by said first arm portion with respect to the horizontal increases, due to the passive transmission of the motive force; and whereby, at each position of said first arm portion, said second arm portion has a maximal range of independent movement with respect to said first arm portion while avoiding positions of backward instability.

2. The load-bearing apparatus according to claim 1, wherein said upright is adapted to assume a constant angular orientation with respect to said reference portion throughout varying movements of said first and second arm portions.

3. The load-bearing apparatus according to claim 2, wherein said upright is adapted to assume a constant, substantially vertical orientation with respect to said reference portion throughout varying movements of said first and second arm portions.

4. The load-bearing apparatus according to claim 1, wherein said at least one displacing element comprises a hydraulic cylinder.

5. The load-bearing apparatus according to claim 4, wherein:

said hydraulic cylinder comprises an extendible rod; and said hydraulic cylinder simultaneously comprises means for:

serving as a passive mechanical link between said first and second arm portions to transmit a motive force from said first arm portion to said second arm portion; and independently moving said second arm portion with respect to said first arm portion via extension and retraction of said rod.

6. The load-bearing apparatus according to claim 1, wherein:

the range of independent movement of said second arm portion with respect to said first arm portion increases as said first arm portion is raised; and positions of backward instability are minimized throughout the increasing range of independent movement as said first arm portion is raised.

7. The load-bearing apparatus according to claim 1, wherein said load-bearing apparatus comprises a boom lift.

8. The load-bearing apparatus according to claim 7, wherein:

said boom lift comprises a work platform and means for automatically levelling said work platform;

said levelling means comprising at least one master cylinder and at least one slave cylinder.

9. The load-bearing apparatus according to claim 1, wherein said first arm portion and said second arm portion are both adapted to pivot through substantially the same plane, as defined by a center-line defined through each of said first and second arm portions.

10. The load-bearing apparatus according to claim 9, further comprising:

a work platform attached to said second arm portion;

the range of independent movement of said second arm portion with respect to said first arm portion including a maximally lowermost position, at which said work platform is disposed substantially at ground level, regardless of the position of said first arm portion.

11. The load-bearing apparatus according to claim 1, wherein said first arm portion includes a telescoping tower boom.

12. The load-bearing apparatus according to claim 1, wherein said at least one displacing element is connected with said first arm portion at no pivot axis that is common to any pivot axis at which said upright is connected with said first arm portion.

13. Method of making load-bearing apparatus, said method comprising:

providing a reference portion;

providing a first arm portion and connecting said first arm portion to extend from said reference portion and to be pivotally displaceable with respect thereto;

providing a second arm portion being pivotally displaceable with respect to said first arm portion;

providing an upright and directly interconnecting said upright between said first and second arm portions;

providing at least one displacing element and directly interconnecting said at least one displacing element between said first and second arm portions; and configuring said at least one displacing element for:

serving as a mechanical link for passively transmitting a motive force from said first arm portion to said second arm portion; and selectively moving said second arm portion independently with respect to said first arm portion;

whereby an angle defined by said second arm portion with respect to the horizontal increases as an angle defined by said first arm portion with respect to the horizontal increases, due to the passive transmission of the motive force; and whereby, at each position of said first arm portion, said second arm portion has a maximal range of independent movement with respect to said first arm portion while avoiding positions of backward instability.

14. The method according to claim 13 wherein said upright is adapted to assume a constant angular orientation with respect to said reference portion throughout varying movements of said first and second arm portions.

15. The method according to claim 14, wherein said upright is adapted to assume a constant, substantially vertical orientation with respect to said reference portion throughout varying movements of said first and second arm portions.

16. The method according to claim 13, wherein said at least one displacing element comprises a hydraulic cylinder.

17. The method according to claim 16, wherein:

said hydraulic cylinder comprises an extendible rod; and said hydraulic cylinder simultaneously comprises means for:

serving as a passive mechanical link between said first and second arm portions to transmit a motive force from said first arm portion to said second arm portion; and independently moving said second arm portion with respect to said first arm portion via extension and retraction of said rod.

18. The method according to claim 13, wherein:

the range of independent movement of said second arm portion with respect to said first arm portion increases as said first arm portion is raised; and positions of backward instability are minimized throughout the increasing range of independent movement as said first arm portion is raised.

19. The method according to claim 13, wherein said load-bearing apparatus comprises a boom lift.

20. The method according to claim 19, wherein:

said boom lift comprises a work platform and means for automatically levelling said work platform;

said levelling means comprising at least one master cylinder and at least one slave cylinder.

21. The method according to claim 13, wherein said first arm portion and said second arm portion are both adapted to pivot through substantially the same plane, as defined by a center-line defined through each of said first and second arm portions.

22. The method according to claim 21, further comprising:

a work platform attached to said second arm portion;

the range of independent movement of said second arm portion with respect to said first arm portion including a maximally lowermost position, at which said work platform is disposed substantially at ground level, regardless of the position of said first arm portion.

23. The method according to claim 13, wherein said first arm portion includes a telescoping tower boom.

24. The method according to claim 13, wherein said at least one displacing element is connected with said first arm portion at no pivot axis that is common to any pivot axis at which said upright is connected with said first arm portion.

* * * * *